US007484263B2

(12) United States Patent
Rice

(10) Patent No.: US 7,484,263 B2
(45) Date of Patent: Feb. 3, 2009

(54) GROUT JOINT CLEAN OUT AND LEVELING TOOL

(76) Inventor: Rodger Rice, 625 Wesley Commons Dr., Flat 34, Golden Valley, MN (US) 55427

( * ) Notice: Subject to any disclaimer, the term of this patent is extended or adjusted under 35 U.S.C. 154(b) by 562 days.

(21) Appl. No.: 11/062,533

(22) Filed: Feb. 22, 2005

(65) Prior Publication Data

US 2006/0185317 A1 Aug. 24, 2006

(51) Int. Cl.
*E04G 21/20* (2006.01)

(52) U.S. Cl. ..... 15/235.3; 15/105.5; 15/245.1

(58) Field of Classification Search ..... 15/105.5, 15/235.3, 235.4, 235.7, 236.01, 236.05, 236.06, 15/236.08, 236.09, 245.1
See application file for complete search history.

(56) References Cited

U.S. PATENT DOCUMENTS 1,195,297 A * 8/1916 Vlchek ..... 30/169
1,262,018 A * 4/1918 Collins ..... 15/235.3
1,310,639 A * 7/1919 Thorson et al. ..... 15/105.5
1,436,254 A * 11/1922 Henry, Jr. ..... 15/105.5
1,445,021 A * 2/1923 Johnson ..... 15/105.5
2,883,854 A * 4/1959 Marmon ..... 15/235.3
3,031,704 A * 5/1962 Farchmin ..... 15/105.5
3,109,189 A * 11/1963 Eldridgr, Jr. ..... 15/105.5
3,154,352 A * 10/1964 Riffelmacher et al. ..... 15/145
3,155,997 A * 11/1964 Gallagher ..... 15/105.5
3,964,854 A * 6/1976 Groeneveld ..... 425/458
4,248,660 A * 2/1981 Johnson ..... 156/579
2004/0060184 A1 4/2004 Shilo et al.
2004/0250364 A1 * 12/2004 Kairys ..... 15/105.5
2004/0250435 A1 12/2004 Fiore

OTHER PUBLICATIONS tiletools.us, Product Listing: Spacers Jan. 3, 2005 (date retrieved from the Internet), 6 pages, (Retrieved from the Internet <UTL: http://www.tiletools.us/index.cfm?Action=ViewCategory&Category-18).

* cited by examiner

*Primary Examiner*—Mark Spisich
(74) *Attorney, Agent, or Firm*—Devan V. Padmanabhan; Dorsey & Whitney LLP

(57) ABSTRACT

A tile adhesive removal system having a handle, or tool, and one or more removable tips. When applying ceramic tiles, one should remove any excess adhesive in the channel between an existing tile and a tile currently under application. A properly-sized tip is selected for a particular channel width, and is removably attached to the handle. The handle and tip together may remove any excess adhesive from the channel between tiles, and then may be easily cleaned for use in applying the next tile. The size of the handle and tip together is large enough so that the cleaning process is relatively simple for the user. The removal system may have an orienting element, so that the tip is not inserted upside down, and may have an attachment element, such as one or more bumps that engage one or more corresponding detents.

17 Claims, 7 Drawing Sheets

GROUT JOINT CLEAN OUT AND LEVELING TOOL

BACKGROUND OF THE INVENTION

1. Field of the Invention

The present invention is directed to ceramic tiling, and more particularly to a tool used to clean out and level the adhesive between ceramic tiles during installation.

2. Description of the Related Art

During the installation of tile, a time-consuming and inconvenient step is the cleaning out of excess adhesive from the grout joints after the tile is beaten in. Tile installation typically proceeds as follows. Tile adhesive is keyed into the backing surface with the straight side of a trowel, and is then combed to a uniform depth using the notched side of the trowel held at a consistent 45°angle. It is good practice to clean the edges next to adjacent tile of excess adhesive with a margin trowel to prevent too much adhesive squeeze into the grout joint. The final step in setting the tile is to beat in the tile with a beating block and rubber mallet. After beat in, the tile surface is cleaned with a tile sponge.

Since adhesive typically is squeezed into the grout joints during beat in and may fill the joints unevenly and in some places to excess, the excess adhesive should be cleaned out from the grout joints when the tile surface is being cleaned. A common method of removing excess adhesive from grout joints is to run a "spacer" along the joint. Spacers are a type of known device for uniformly spacing tiles during installation to establish uniform grout joints. Although they are commonly used by tile professionals for excess adhesive removal, they are not specifically made for this purpose. A typical spacer is made from a non-porous material such as plastic or rubber, and resembles a "+"-sign. Prong widths of 1/16 inch, 1/8 inch, 3/16 inch and 1/4 inch are typical. Once the adhesive dries, the spacers in place between the tiles are removed, and grout is applied over the dried adhesive in the region between the tiles.

When removing excess adhesive with a spacer, the spacer is run down the grout joints at an incline so that the spacer does not reach the bottom of the channel between the tiles. It is preferable to leave some adhesive in the region between the tiles to increase the bonding strength of the tiles. The spacer collects the excess adhesive down to a depth that typically and disadvantageously is neither precisely known nor constant, leaving a channel of adhesive that irregularly fills a portion of the grout joint between the tiles.

There are several drawbacks to using a spacer to remove the excess adhesive. First, the spacers themselves are relatively small, which makes them difficult to handle and can cause discomfort to the fingers. Second, after a spacer has been used to remove the excess adhesive, it is difficult to clean because of its small size, and as a result typically ends up being thrown out. This is wasteful. Third, if a tiling job entails a large number of tiles, a large number of spacers may be used for cleaning out the excess adhesive between the tiles, and may therefore be thrown out. This may prove expensive, and the large number of spacers that are used only for cleaning may unnecessarily increase the cost of the job.

Accordingly, there exists a need for a tool that is comfortable to use, can remove the excess adhesive from the channel between adjacent ceramic tiles during installation, can be cleaned easily for reuse, and can easily accommodate a variety of installation spacings between the tiles.

BRIEF SUMMARY OF THE INVENTION

One object of the present embodiment is a tool for leveling and cleaning out tile adhesive in a grout joint between adjacent tiles, comprising a handle; and a tip extending from the handle, the tip comprising an alignment surface; and a member projecting from the alignment surface and generally established about a first plane with a width within the plane substantially equal to the width of the grout joint, and a height within the first plane for extending into the grout joint a predetermined distance from the alignment surface.

Another embodiment is a removable tip for a tool for leveling and cleaning out tile adhesive in a grout joint between adjacent tiles, comprising a connector for removably coupling the tip to the tool; an alignment surface distally spaced from the connector; and a member projecting distally from the alignment surface and generally established about a plane with a width within the plane substantially equal to the width of the grout joint, and a height within the plane for extending into the grout joint a predetermined distance from the alignment surface.

Another embodiment is a system for removing excess adhesive in a channel between adjacent tiles, comprising a handle having an attachment end; and at least one removable tip that attaches to the attachment end of the handle, the at least one removable tip having a ridge that is insertable into the channel between adjacent tiles.

Another embodiment is a removable tip for a tool for leveling and cleaning out tile adhesive in a grout joint between adjacent tiles, comprising means for connecting the tip to the tool; means for aligning the tip to the grout joint; and means for dispersing excess adhesive as the tool is translated along the grout joint.

DETAILED DESCRIPTION OF THE INVENTION

A grout joint clean out and tile adhesive leveling tool has a tip and a handle. The tip has an alignment surface for slidably resting upon the faces of adjacent tiles, and a projecting member having a width substantially equal to the width of the grout joint, and a height for extending into the grout joint a predetermined distance from the alignment surface. When the tool is moved along the grout joint, the projecting member redistributes and/or removes excess tile adhesive from the grout joint so as to leave a uniform layer of adhesive of a particular desired thickness in the bottom of the grout joint. Preferably the tip is designed for repeated use and is made of a slick, non-porous, rigid and durable material so as to slide easily over tile without absorbing the excess tile adhesive, to withstand the stresses to which it is subject during normal use on multiple occasions, and to withstand water and other solvents with which it might come into contact during normal use and cleaning on multiple occasions. Alternatively, the tip may be made of any desired material or combination of materials to achieve any of a variety of different performance objectives; illustratively, the tip may be semi-porous and impregnated with water or other solvent for aiding in the redistribution and/or removal of adhesive, and may be made for limited use. The handle may have any configuration and size suitable for the user, and may connect to the tip via a shaft of any length or configuration as may be desired for convenience and ease of use. The tip and handle may be a unitary structure such as, for example, a single molded plastic piece, or may be an integrated structure of the same or different materials. In an integrated structure, the tip may be permanently secured to the handle with an adhesive, weld, or in any other desired manner, or the tip may be removably attached to the handle with a mechanical or any other type of temporary connector so that it can be removed and replaced. Preferably the connector is operable by the user so that the tip may be changed by the user as needed.

For a particular tiling scheme, in which the spacing between tiles is known, the user selects a tip of a size that corresponds to the spacing, attaches it to the handle (for a tool having changeable tips), and uses the handle and tip to remove the excess adhesive in the channel between adjacent tiles. After a pass along the channel, the excess adhesive captured by the tip is easily removed from the handle and tip, and the handle and tip are easily cleaned for use in application of the next tile. The combined size of the handle and tip is preferably large enough so that the handle and tip may be easily washed off together in a container of water, which is difficult to do with a common spacer.

Figure 1:
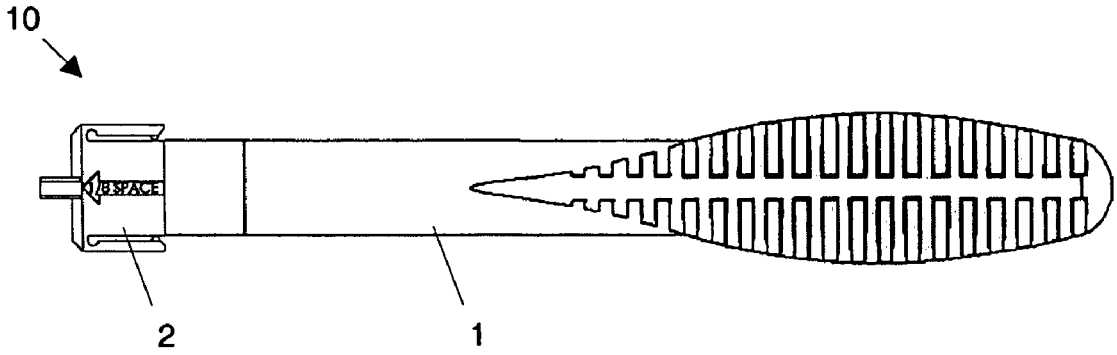
FIG. 1 is a top view drawing of a tile adhesive removal tool with a handle and removable tip.

An example of a tile adhesive removal tool 10 is shown in FIG. 1. A tip 2 is attached to a handle 1. The tip has a ridge that is sized to fit in the channel between adjacent tiles. During use, a user grips the handle, inserts the ridge of the tip into one end of the channel, and guides the tool along the channel to remove any excess adhesive in the channel. As drawn in FIG. 1, the tip 2 is removable from the handle 1, but it may alternatively be integrated into the handle 1.

Figure 2:
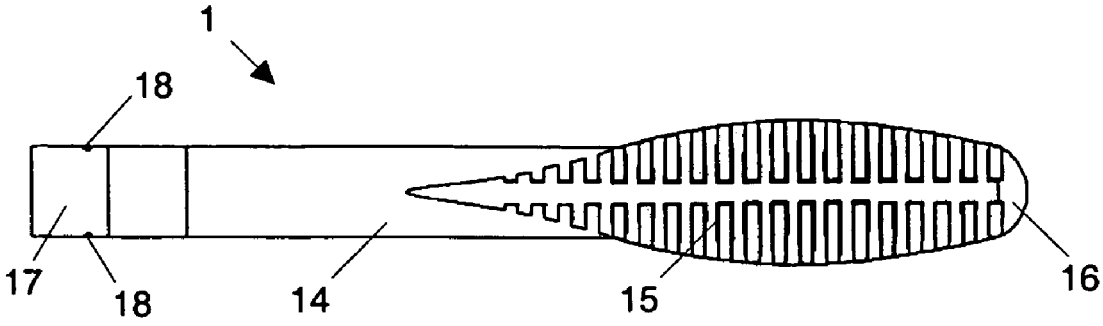
FIG. 2 is a top view drawing of a handle for the tile adhesive removal tool of FIG. 1.
Figure 3:
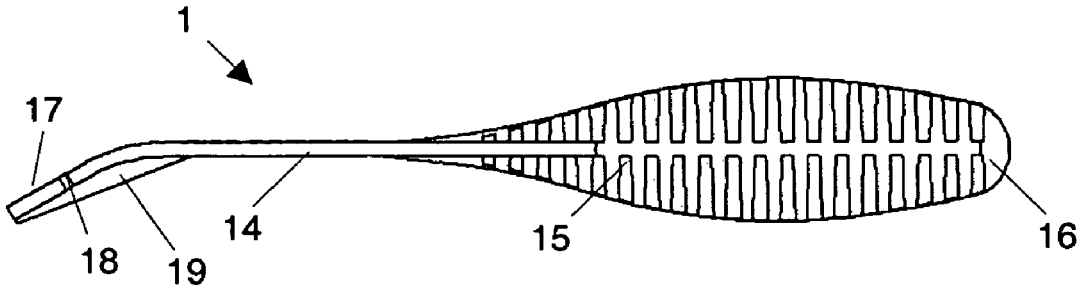
FIG. 3 is a left side view drawing of the handle of FIG. 2.
Figure 4:
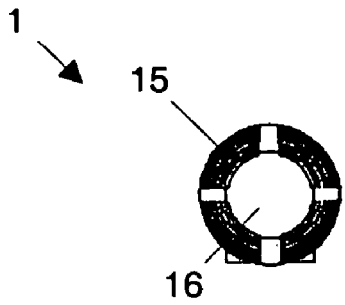
FIG. 4 is a proximal end view drawing of the handle of FIGS. 2 and 3.

The handle 1 of FIG. 1 is shown in more detail in FIGS. 2-4. FIG. 2 shows a top view, FIG. 3 shows a left side view, and FIG. 4 shows a proximal end view. The handle 1 has a body 14 that is gripped by the user in a grip region 15, which may optionally have grooves, bumps or ridges for enhancing the grip of the user on the handle 1. Alternatively, the grip region 15 may be flat.

Adjacent to the grip region 15 at the proximal end of the handle 1 is a storage compartment cover 16. The cover 16 may unscrew from the handle 1 to allow the user to store parts or extra tips inside the handle 1. Alternatively, the cover 16 may be secured by any applicable method, such as by being hinged or having a friction fit.

Opposite the storage end of the handle 1 is the attachment end 17, to which a removable tip may be attached. The removable tip fits securely onto the attachment end 17 of the handle 1, and is held in place by a friction fit, a mechanical device, or in any other desired manner. Preferably, a friction fit is used in conjunction with a pair of notches 18 on the attachment end 17, which engage a pair of detents on the removable tip. The user presses the removable tip on the attachment end 17 of the tool until the detents engage the notches 18. The tip may be removed by gripping and pulling it off the attachment end 17 of the handle 1.

The attachment end 17 of the handle 1 may optionally have an orientation ridge 19 on one side, so that the removable tip may be attached with only one particular orientation. As drawn in FIGS. 2-4, the orientation ridge 19 protrudes along the attachment end 17 in a relatively narrow channel, and engages a slot in the removable tip, so that the tip is prevented from being attached upside down. Alternatively, the orientation ridge 19 may be located off-center with respect to the attachment end 17. As a further alternative, the orientation ridge 19 may be one or more bumps on the attachment end 17, rather than a true ridge.

Figure 8:
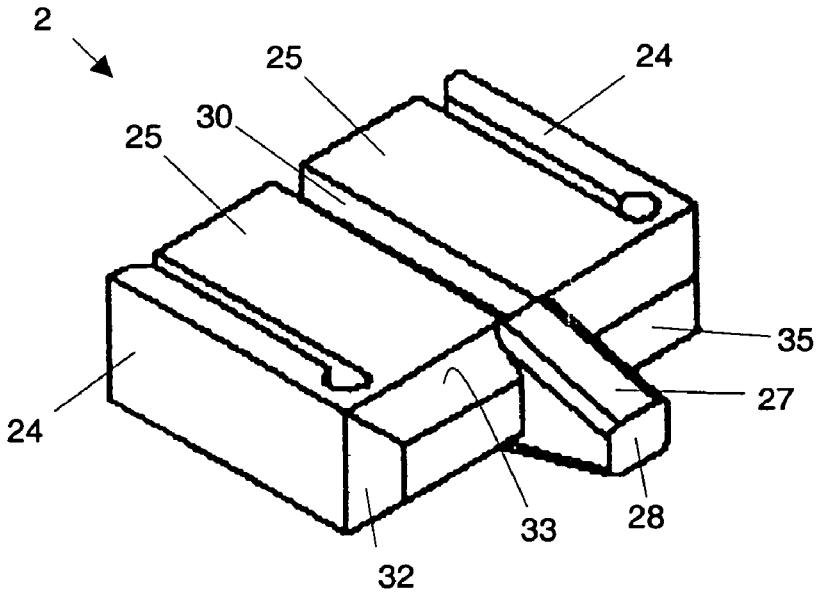
FIG. 8 is a plan drawing of the removable tip of FIGS. 5-7.
Figure 5:
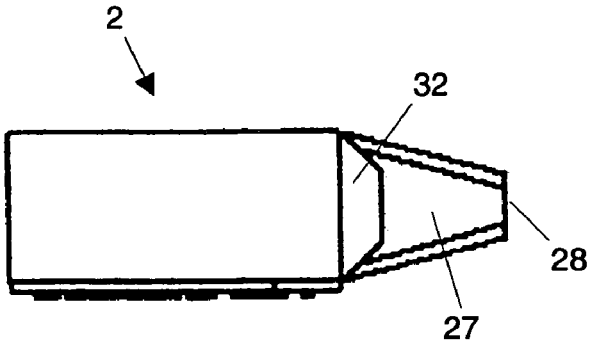
FIG. 5 is a side view drawing of a removable tip for the tile adhesive removal tool of FIG. 1.
Figure 6:
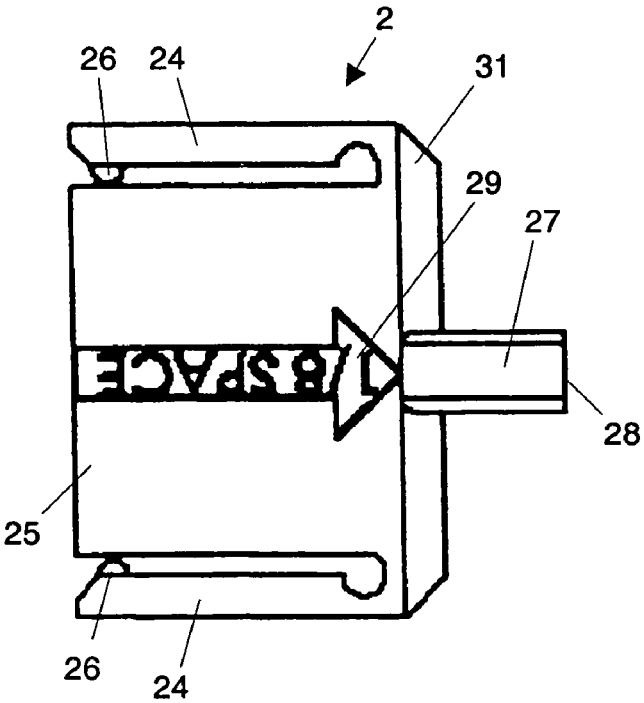
FIG. 6 is a top view drawing of the removable tip of FIG. 5.
Figure 7:
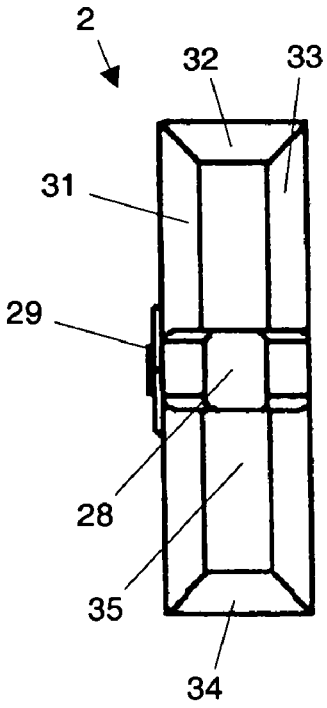
FIG. 7 is a distal end view drawing of the removable tip of FIGS. 5 and 6.

FIGS. 5-8 show an exemplary embodiment of a removable tip 2 in various views. FIG. 5 shows a side view, FIG. 6 shows a top view, FIG. 7 shows a distal end view, and FIG. 8 shows a plan view of the underside of the removable tip 2. The removable tip 2 has a main body 25, which attaches the removable tip 2 to the attachment end 17 of the handle 1. Protruding from the main body 25 is an insertable ridge 27, which during use extends into the groove or channel between tiles and redistributes or removes any excess adhesive. As shown in FIGS. 5-8, the insertable ridge 27 may optionally be tapered in one or more dimensions, preferably decreasing in size away from the main body 25. The end 28 of the insertable ridge 27 may be flat, as drawn in FIGS. 5-8, or may be rounded in one or more dimensions.

The main body 25 attaches to the handle 1, and in the exemplary embodiment of FIGS. 5-8, has a pair of resilient arms 24 located on opposite sides of the main body 25. At one end of each arm 24 is a bump 26, which engages a notch 18 on the handle 1 when the removable tip 2 is attached. One of ordinary skill in the art will appreciate that any suitable method of attachment may be used to attach the removable tip to the tool; the bumps and detents shown in FIGS. 2-8 are merely exemplary.

If the tip is designed asymmetrically, it may be desirable to have element that prevents the tip from being installed upside-down. The tool of FIGS. 2-8 uses an orientation ridge 19 on the handle 1, which fits into an alignment groove 30 on the removable tip 2. If the user attempts to attach the tip with the incorrect orientation, the orientation ridge 19 prevents the placement of the removable tip 2 onto the attachment end 17 of the handle 1. Although the alignment groove 30 is shown as being centered on one face of the removable tip 2, it may also be off-center. Alternatively, more than one groove and ridge may be used. As a further alternative, one or more bumps on the tool may be used, rather than a ridge. As yet another alternative, the ridge may be on the tip, rather than the tool, and the channel may be on the tool, rather than the tip. One of ordinary skill in the art will appreciate that the embodiment may use any other suitable method of preventing the insertion of the removable tip with an incorrect orientation.

Figure 9:
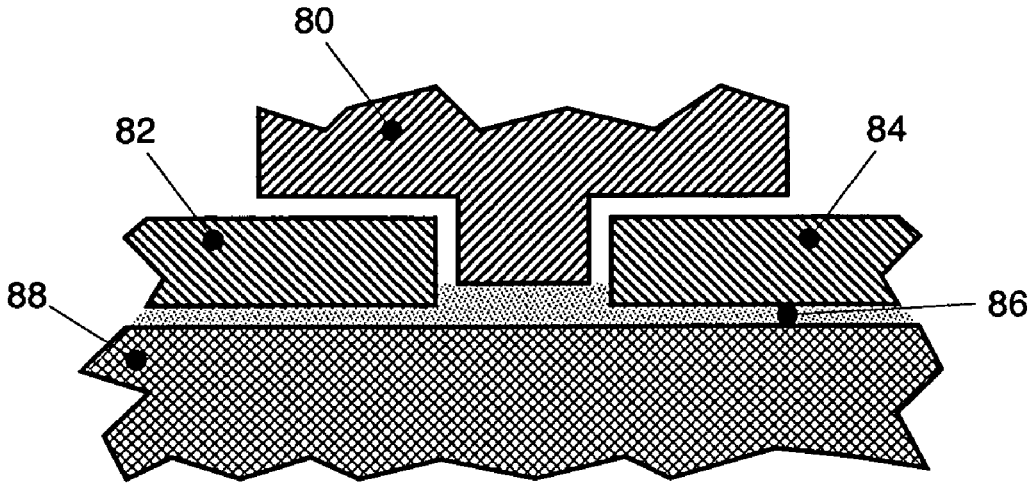
FIG. 9 is a cross-sectional drawing of a tile adhesive removal tool used in a relatively shallow, wide grout joint.
Figure 10:
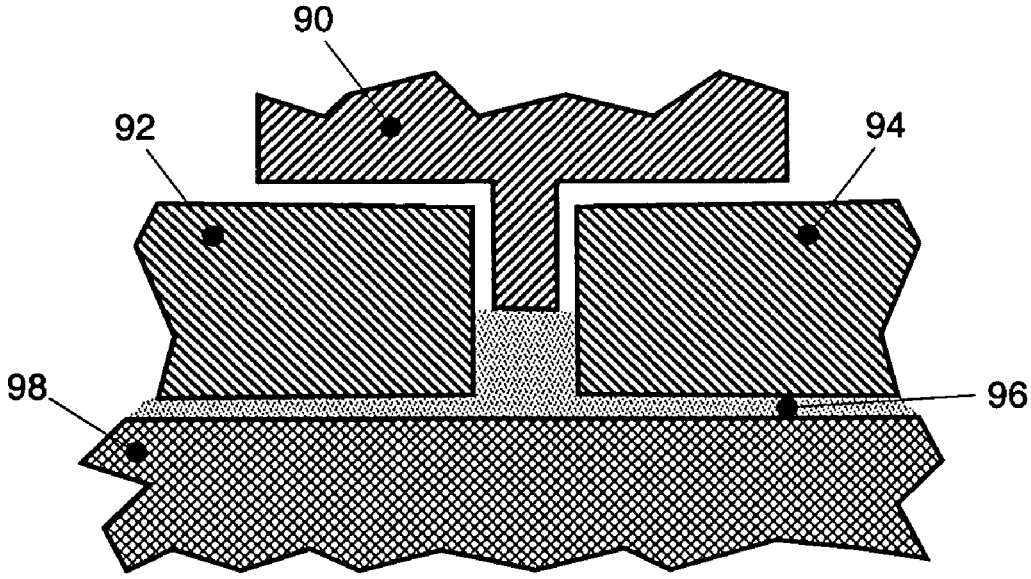
FIG. 10 is a cross-sectional drawing of a tile adhesive removal tool used in a relatively deep, narrow grout joint.

Because a variety of tiles with different thickness are available and because a variety of grout joint thickness are desired by installers, tips may be made available in a variety of different dimensions. FIG. 9 shows an installation in which relatively thin tiles 82 and 84 are installed on backing 88 with a relatively wide grout joint between them. The use of a tool with a relatively wide but shallowly projecting tip 80 is appropriate. Element 86 is the adhesive in the grout joint. On the other hand, FIG. 10 shows an installation in which relatively thick tiles 92 and 94 are installed on backing 98 with a relatively narrow grout joint between them. The use of a tool with a relatively narrow but deeply projecting tip 90 is appropriate. Element 96 is the adhesive in the grout joint.

The removable tip may optionally have a label 29 that indicates the width of the insertable ridge 27, which is the top-to-bottom dimension of the insertable ridge 27 in FIG. 6. By reading the label 29, the user knows the size of the insertable ridge 27, and therefore knows which removable tip to use for a given spacing between tiles. The exemplary label 29 in FIG. 6 reads "⅛SPACE", which indicates that the width of the insertable ridge is ⅛ inch. The tool 10 may be sold with a set of removable tips, each with a different dimension, so that a variety of tiling schemes may be accommodated. Typical dimensions include, but are not limited to 1/16 inch, ⅛ inch, 3/16 inch and ¼ inch.

The removable tip 2 may be tapered or rounded in any of the dimensions, in addition to the optional taper of the insertable ridge 27. The tapered regions 31 reduce the overall size of the removable tip, and therefore use less material, resulting in a less expensive product. Furthermore, the tapered region 31 may make easier the cleaning of the tip, which occurs after use for a particular tile.

Figure 11:
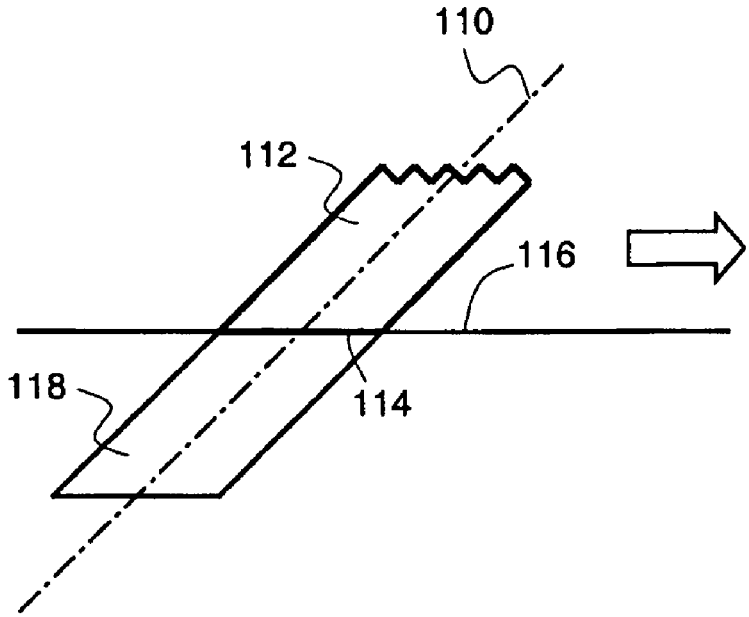
FIG. 11 is a cross-sectional drawing of a tile adhesive removal tool that uses the body of the tool to set the orientation angle at which the tool is held.
Figure 12:
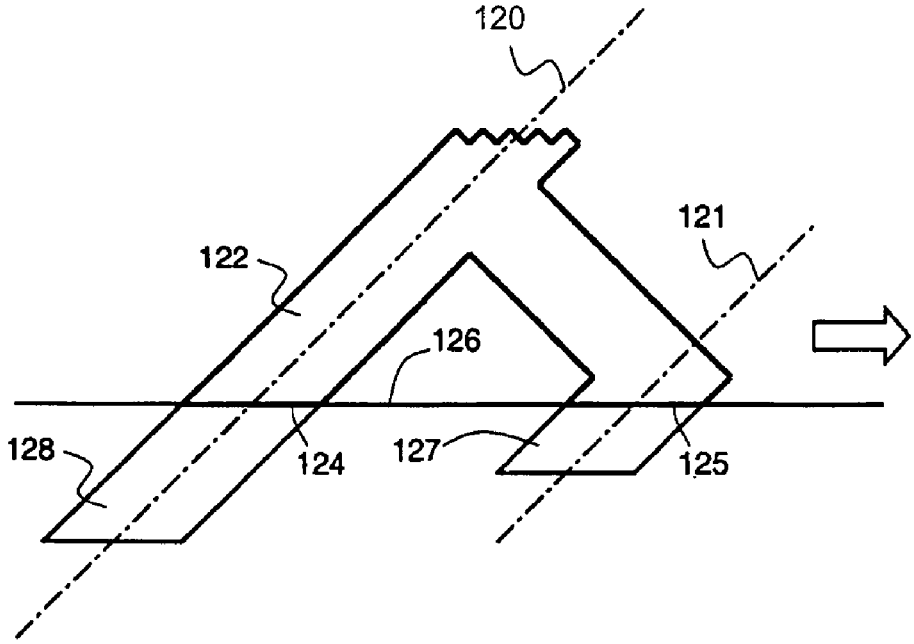
FIG. 12 is a cross-sectional drawing of a tile adhesive removal tool with multiple tips.
Figure 13:
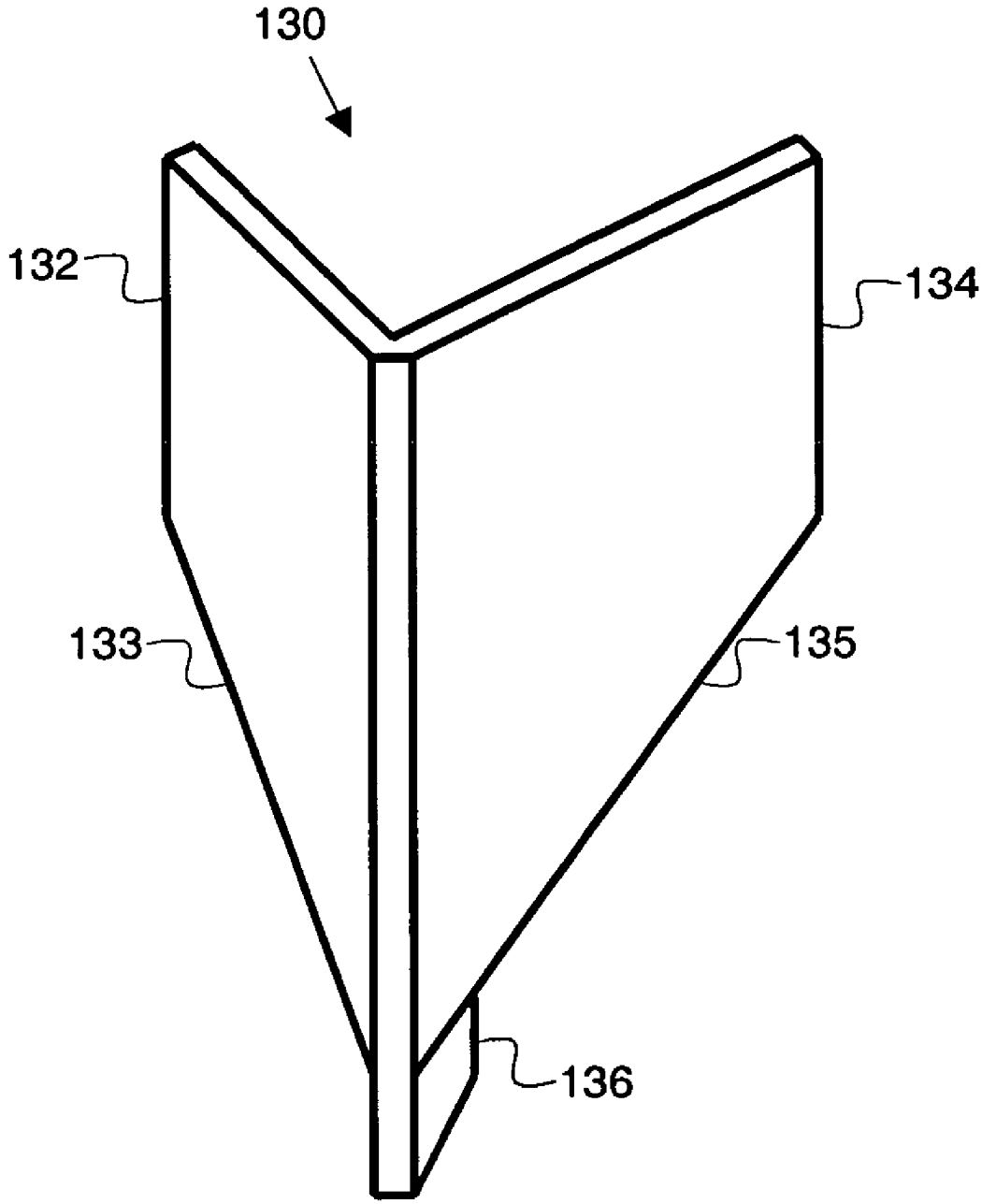
FIG. 13 is a plan drawing of a tip that has bent back portions for setting the angle at which the tool is held.

In the tool of FIGS. 1-8, the alignment surface of the tool 10 is preferably either the beveled surface 31 or the beveled surface 33, depending on the orientation of the tool 10 relative to the direction of travel. The tool 10 preferably is angled away from normal in the direction of travel, and the beveled surface 31 or 33 provides some tactile feedback when the tip 2 is properly angled. However, many different techniques may be used to facilitate the proper angling of the tip. FIG. 11 shows a simplified and less flexible implementation in which the proper angle between tool axis 110 and tile surface 116 is maintained by flat surface 114 of main body 112, thereby establishing the proper penetration distance of projecting member 118. FIG. 12 shows a dual-tip embodiment in which the proper angle between primary tool axis 120 and a parallel secondary tool axis 121 and tile surface 126 is maintained by the cooperative effect of spaced-apart surfaces 124 and 125 of main body 122, thereby establishing the proper penetration distance of projecting members 127 and 128. FIG. 13 shows yet another technique in which the main body of tip 130 is not slab-like as in FIG. 7, but rather has bent back portions 132 and 134 with respective edges 133 and 135. The edges 133 and 135 are angled so that when the tool to which the tip 130 is connected is properly angled, the edges 133 and 135 are in full contact with the surfaces of adjacent tiles defining the grout joint, thereby establishing the proper penetration distance of projecting member 136.

Preferably measures are taken to prevent twisting of the tip in the grout joint. When a single tip is used, the length of the projecting member is preferably greater than the width thereof. In FIG. 11, for example, the projecting member 118 is shown from the side or along its length. The width (not shown) of the projecting member preferably is equal to or less than the length. On the other hand, the length of the projecting members 127 and 128 of the tip shown in FIG. 12 may be less than the width thereof, since twisting is prevented by using two projecting members 127 and 128 in a spaced-apart relationship.

The tip of FIG. 12 has a further advantage. In the implement shown in FIG. 12, the height of the leading projecting member 127 is less than the height of the trailing projecting member 128. When the tool is in use, the projecting member 127 may remove and/or redistribute great excesses of adhesive from the grout joint without causing too much drag on the tool, while the projecting member 128 is at the proper height to level the adhesive at the right depth even while removing and/or redistributing lesser excesses of adhesive. However, the height may be established for other purposes. Illustratively, the height of the projecting members of the tip may be the same for redundancy.

Figure 14:
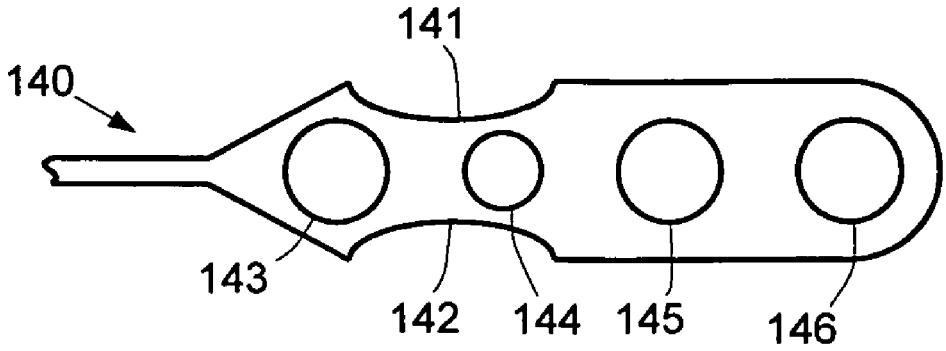
FIG. 14 is a left side view drawing of an alternate embodiment of a handle.
Figure 15:
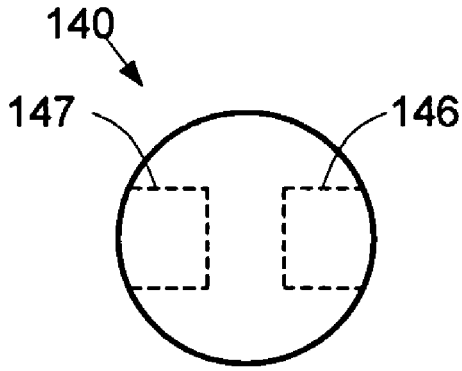
FIG. 15 is a proximal end view drawing of the handle of FIG. 14.

FIGS. 14 and 15 show an alternate embodiment of a handle 140. The handle 140 has various features that may enhance a user's grip on the tool, including depressions 141 and 142 and holes 143, 144, 145, 146 and 147. The holes preferably do not extend all the way through the handle 140, although alternatively they may extend fully through the handle 140. In addition to enhancing the grip, the features may reduce the overall volume of the handle 140, thereby using less material for its production and reducing the overall cost of the tool.

The description of the invention and its applications as set forth herein is illustrative and is not intended to limit the scope of the invention. Variations and modifications of the embodiments disclosed herein are possible, and practical alternatives to and equivalents of the various elements of the embodiments would be understood to those of ordinary skill in the art upon study of this patent document. These and other variations and modifications of the embodiments disclosed herein may be made without departing from the scope and spirit of the invention.

The invention claimed is:

1. A tool for leveling and cleaning out tile adhesive in a grout joint between adjacent tiles, comprising:

a handle; and a tip extending from the handle, the tip comprising:

an alignment surface; and a member projecting from the alignment surface and generally established about a first plane with a width within the plane substantially equal to a width of the grout joint, and a height within the first plane for extending into the grout joint a predetermined distance from the alignment surface, wherein the tip and the handle are distinct pieces;

the tip is removably connected to the handle;

the handle comprises a pair of detents spaced laterally on opposite sides of a distal portion thereof; and the tip comprises a pair of bumps spaced laterally on opposite sides of the tip, for removably engaging the detents to attach the tip to the handle.

2. The tool of claim 1, wherein the handle and the tip are adapted to be removably connected in a single orientation.

3. The tool of claim 2, wherein:

the handle comprises a bump projecting from a distal portion thereof; and the tip comprises a longitudinal slot for removably engaging the bump when the tip is attached to the handle for orienting the tip with respect to the handle.

4. The tool of claim 1, wherein the tip is adapted to prevent twisting in the grout joint.

5. The tool of claim 4, wherein the member projecting from the alignment surface has a length along the grout joint greater than the width of the member.

6. The tool of claim 4, further comprising a secondary tip extending from the handle in a spaced-apart relationship from the tip, the secondary tip comprising a secondary alignment surface and a secondary projecting member.

7. The tool of claim 6, wherein the secondary projecting member has a height less than the height of the member projecting from the alignment surface.

8. The tool of claim 1, wherein the handle is hollow.

9. The tool of claim 8, wherein the handle is adapted to store parts or extra tips.

10. The tool of claim 9, wherein the handle further comprises a storage compartment.

11. The tool of claim 10, wherein the handle further comprises a cover for the storage compartment.

12. The tool of claim 1, wherein the handle has a grip region.

13. The tool of claim 12, wherein the grip region comprises at least one of grooves, bumps, ridges, holes, and depressions.

14. The tool of claim 1, wherein the tip includes a tip width identification index disposed on a surface thereof.

15. The tool of claim 14, wherein the tip is selectable from a plurality of tips, the plurality of tips having varying tip widths and associated tip width identification indexes.

16. The tool of claim 1, wherein the tip at least generally comprises a slick, non-porous, rigid and durable material.

17. The tool of claim 1, wherein the tip at least generally comprises a semi-porous material impregnated with an adhesive solvent.

* * * * *